US008246287B1

(12) United States Patent
Westendorf

(10) Patent No.: US 8,246,287 B1
(45) Date of Patent: Aug. 21, 2012

(54) GUARD STRUCTURE FOR FLUID CONDUITS OF HYDRAULIC CYLINDERS AND HYDRAULIC LINES

(75) Inventor: Neal W. Westendorf, Dakota Dunes, SD (US)

(73) Assignee: Westendorf Manufacturing, Co., Onawa, IA (US)

( * ) Notice: Subject to any disclaimer, the term of this patent is extended or adjusted under 35 U.S.C. 154(b) by 540 days.

(21) Appl. No.: 12/038,379

(22) Filed: Feb. 27, 2008

Related U.S. Application Data

(63) Continuation of application No. 12/009,003, filed on Jan. 16, 2008, now abandoned.

(51) Int. Cl.
*B66C 23/00* (2006.01)
*B66F 9/00* (2006.01)
*E02F 3/00* (2006.01)

(52) U.S. Cl. ..... 414/722

(58) Field of Classification Search ..... 414/722, 414/680, 685, 695.5; 280/304.3; 137/377; 92/169.1, 171.1; 188/322.12
See application file for complete search history.

(56) References Cited

U.S. PATENT DOCUMENTS 2,365,268 A * 12/1944 Herter, Jr. ..... 66/170
3,252,606 A 5/1966 Pryor
3,292,804 A 12/1966 Veneman
3,794,091 A * 2/1974 Ersek et al. ..... 150/154
3,812,282 A 5/1974 Johansson
3,850,141 A 11/1974 Schmitt
3,997,986 A 12/1976 Black
4,050,596 A 9/1977 Zeuner
T974001 I4 9/1978 Neal
4,156,487 A 5/1979 Dowd
4,167,991 A 9/1979 Karklins
4,193,734 A 3/1980 Williams
4,265,063 A 5/1981 Muller
4,267,674 A 5/1981 Muller
4,320,783 A 3/1982 Neal
4,372,429 A 2/1983 Marx
4,591,137 A 5/1986 Steinberg
4,644,094 A 2/1987 Hoffman
4,658,854 A 4/1987 Hopkins
4,773,451 A * 9/1988 Hegler et al. ..... 138/106
4,955,193 A * 9/1990 Hoeptner, III ..... 60/320
5,074,390 A 12/1991 Fuhrmann
5,108,253 A 4/1992 Kobayashi
5,232,330 A 8/1993 Rae
5,542,339 A 8/1996 Kaczmarczyk
(Continued)

*Primary Examiner* — Dean Kramer
*Assistant Examiner* — Stephen Vu
(74) *Attorney, Agent, or Firm* — Dowell IP, P.C.

(57) ABSTRACT

The hydraulic cylinder and line guard of the claimed invention substantially surrounds and protects both a hydraulic cylinder and portions of a hydraulic line. The guard also significantly reduces the visual appearance of the hydraulic lines. While maintaining the flexibility of the hydraulic lines at pivot points, the guard inhibits movement of the line near the cylinder thereby reducing wear on the line. The claimed invention also achieves the important objective of providing an aesthetically pleasing and easily replaceable guard for hydraulic cylinders and lines. The improved guard is achieved by utilizing a resilient guard to cover both the cylinder and the line. The guard may be formed from a single stretchable resilient tube that is deformed to enclose both the line and the cylinder, wherein a cross-section of the guard is defined primarily by combined cross sections of the cylinder adjacent to the line. The guard may also be formed from multiple interconnected resilient segments that combine to substantially enclose a hydraulic line and cylinder. The guard may further have a raised wear surface arranged in an ornamental and/or functional pattern.

11 Claims, 15 Drawing Sheets

U.S. PATENT DOCUMENTS

| | | | | |
|---|---|---|---|---|
| 5,791,445 | A | 8/1998 | Kaufmann | |
| 5,806,313 | A | 9/1998 | Koshi | |
| 5,807,061 | A | 9/1998 | Donoghue | |
| 5,871,269 | A * | 2/1999 | Chien | 362/474 |
| 6,171,050 | B1 | 1/2001 | Johnson | |
| 6,425,730 | B1 | 7/2002 | Kaczmarczyk | |
| 6,530,742 | B2 | 3/2003 | Trinler | |
| 6,763,625 | B2 * | 7/2004 | Durham | 40/590 |
| 6,994,512 | B2 | 2/2006 | Stender | |
| 7,008,169 | B1 | 3/2006 | Miyanishi | |
| 7,021,668 | B2 | 4/2006 | Langenfeld | |
| 7,070,383 | B2 | 7/2006 | Sugimoto | |
| 7,219,780 | B2 | 5/2007 | Thurmann | |

* cited by examiner

PRIOR ART

FIG. 19
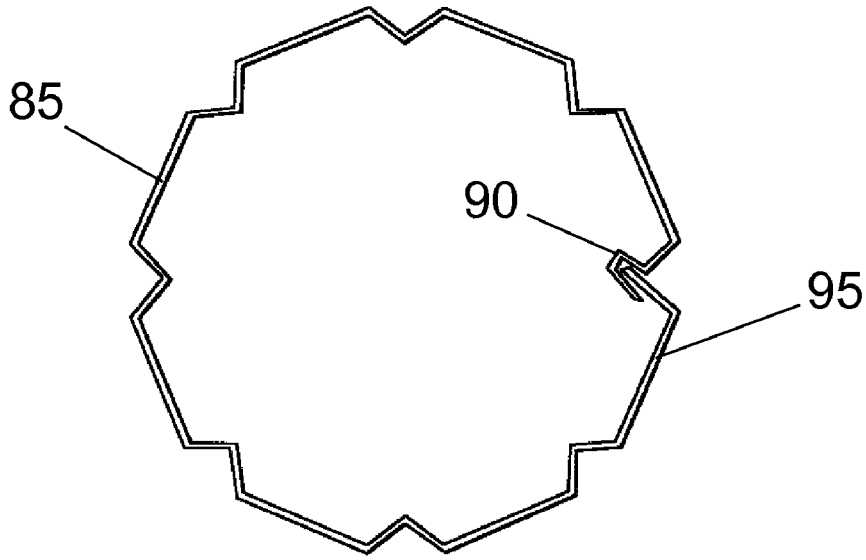
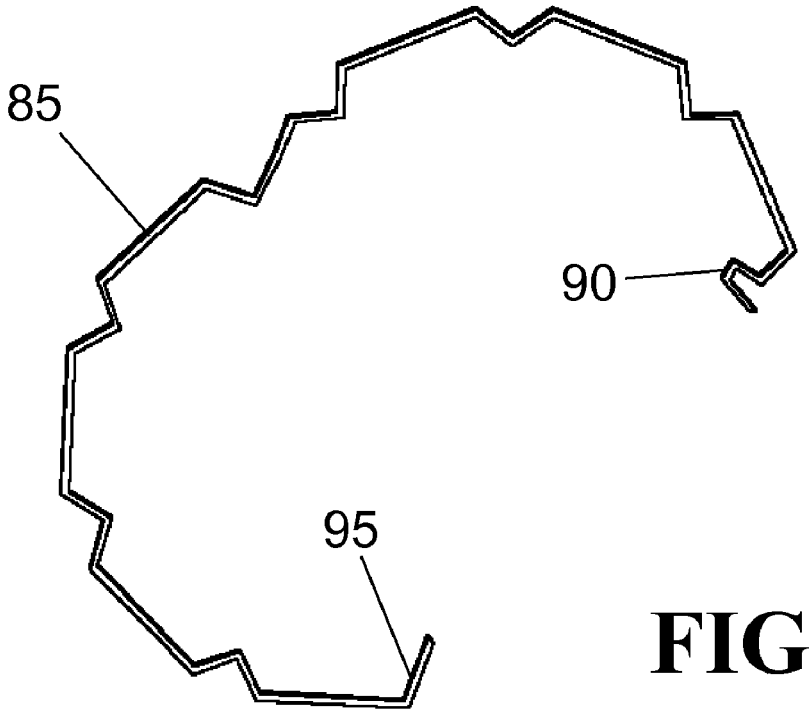
FIG. 20

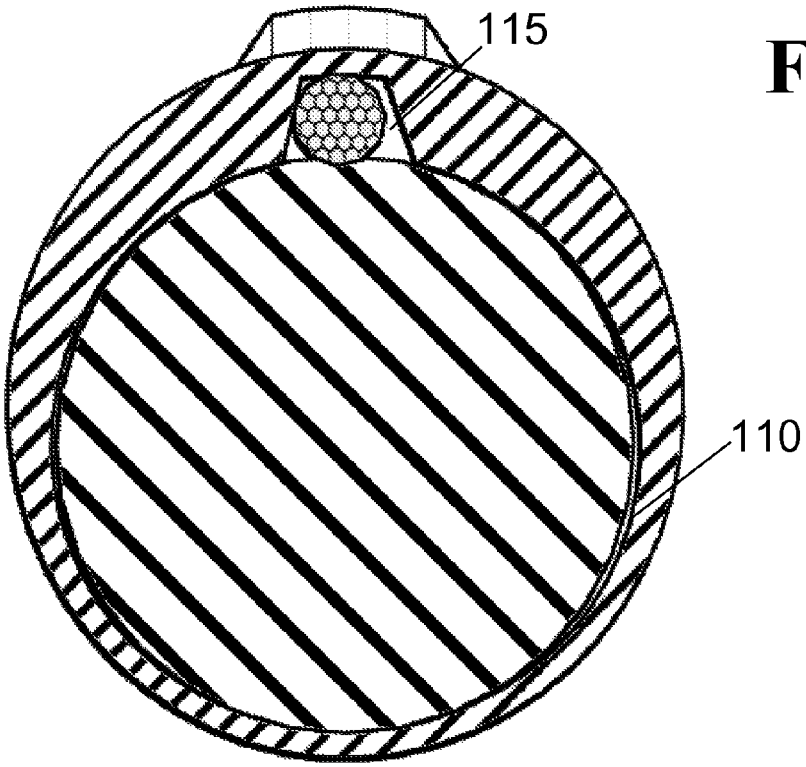
FIG. 23
FIG. 24
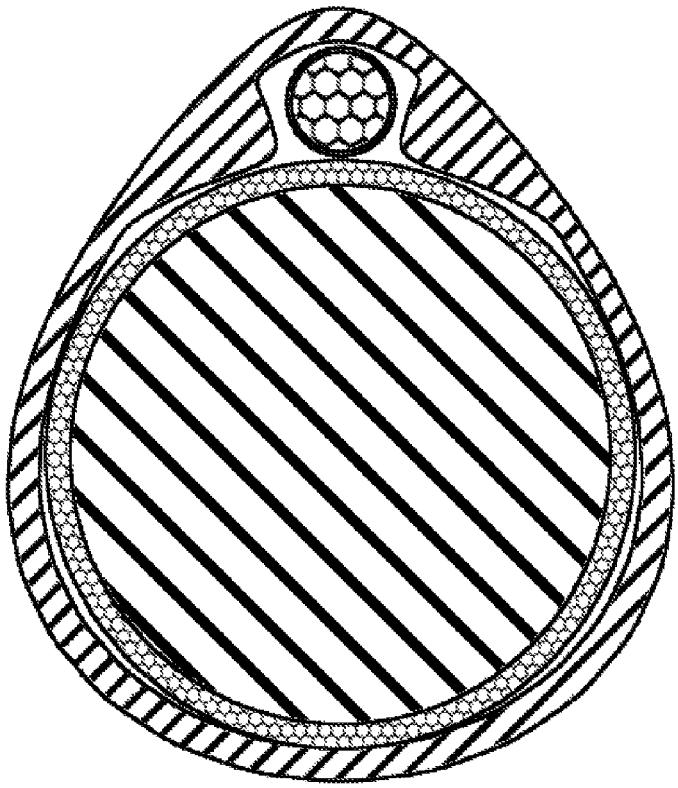

FIG. 28
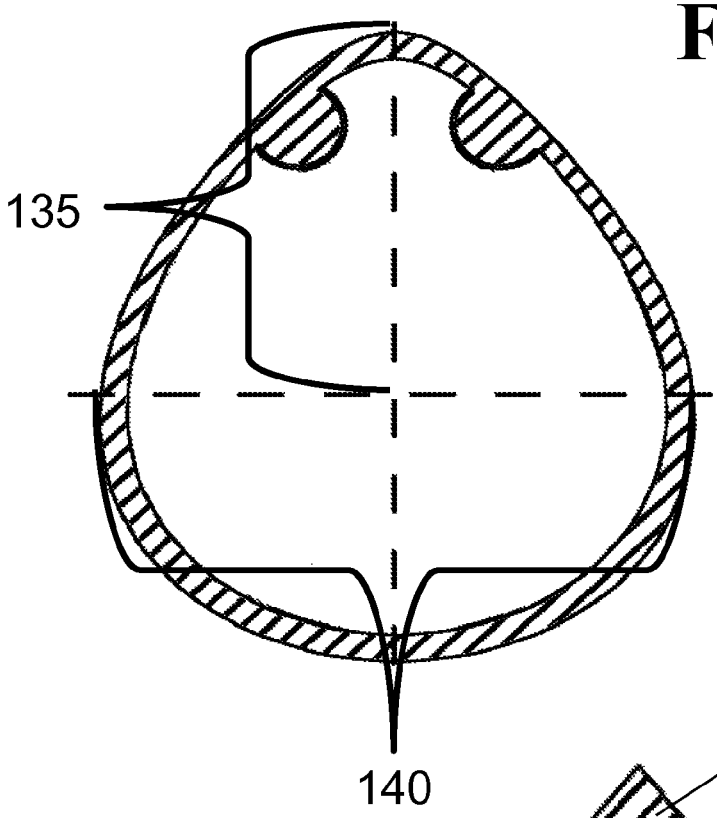
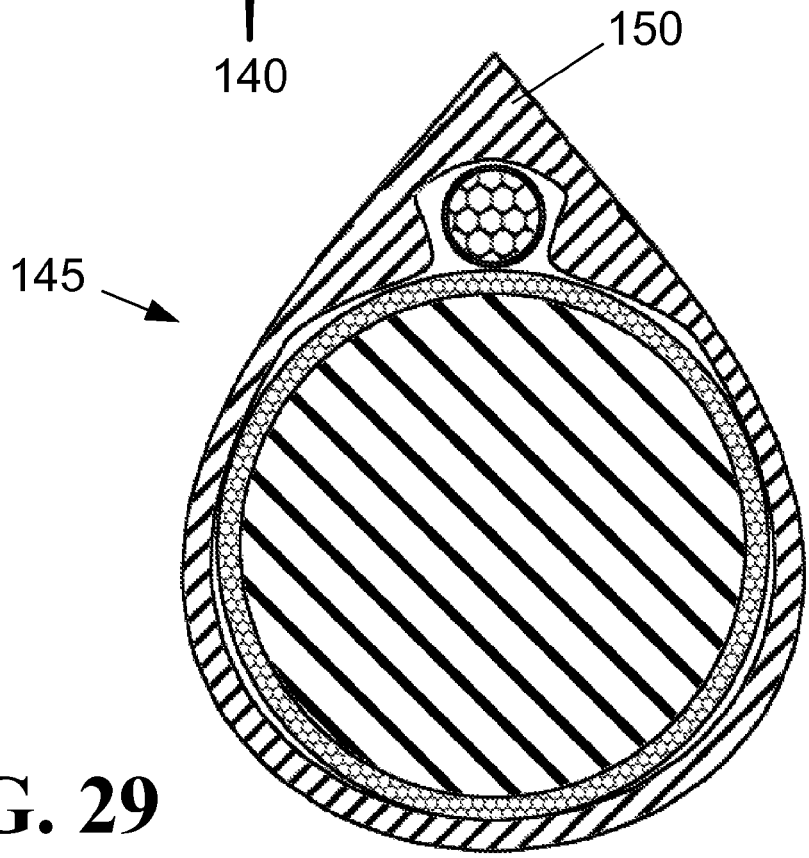
FIG. 29

GUARD STRUCTURE FOR FLUID CONDUITS OF HYDRAULIC CYLINDERS AND HYDRAULIC LINES

CROSS-REFERENCE TO RELATED APPLICATION

This application is a Continuation of application Ser. No. 12/009,003 now abandoned, entitled "Guard structure for fluid conduits of hydraulic cylinders and hydraulic lines" and filed Jan. 16, 2008 the contents of which are incorporated herein by reference.

FIELD OF THE INVENTION

This invention relates to structures for protecting hydraulic conduits and for substantially removing the appearance of the conduits. This invention further relates to protecting hydraulic lines and cylinders on the booms of front-end loaders that have arm assemblies pivotally attached to buckets, clam shells, plows, fork lifts, bale spears and related implements.

BACKGROUND OF THE INVENTION

Agricultural and construction vehicles typically employ hydraulic cylinders to power a variety of specialty implements that attach to the vehicles. For example, typical front-end loaders have a pair of arms that are raised and lowered by hydraulic cylinders, as well as implements attached to the arms that are operated by hydraulic cylinders. Some exemplary front end loaders using hydraulic lines to power hydraulic cylinders are described by U.S. Pat. No. 3,512,665 to Westendorf; U.S. Pat. No. 4,085,856 to Westendorf; U.S. Pat. No. 4,787,811 to Langenfeld et al.; U.S. Pat. No. 4,051,962 to Westendorf; U.S. Pat. No. 4,606,692 to Langenfeld et al.; and U.S. Pat. No. 4,930,974 to Langenfeld et al., all incorporated herein by reference.

Hydraulic lines are required to deliver hydraulic fluid to hydraulic cylinders. Additionally, two way cylinders must be connected to hydraulic lines at two ports typically located on opposite ends of the cylinders. In order to provide hydraulic fluid to most commonly available cylinders, at least one hydraulic line is usually strung along the cylinder to connect near the rod end of the cylinder. Thus, loaders that have multiple two way cylinders to operate implements are typically required to have many (often unsightly) hydraulic lines strung along the arms of the loader as shown in FIGS. 1-4. Loaders with complex implements, such as pinching fingers, often have even more hydraulic lines.

It is known in the prior art, as shown in FIG. 1 from U.S. Pat. No. 4,050,596 and FIGS. 2-4, that hydraulic cylinders 10 and hydraulic lines 15 connected to lift arms 20 and implement attachments 25 are commonly located on portions of loaders 30 exposed to potentially rough environments. Hydraulic lines 15 are particularly susceptible to being snagged on objects since the lines must be relatively slack to allow for movement of the hydraulic cylinders. Hydraulic lines 15 connected to the lift arm 20 may also snag on or be pinched by the engine compartment 35 when the lift arms are raised and lowered.

The problem of developing a guard structure for hydraulic lines is further complicated by the flexible hydraulic conduits extending along the boom. The guard structure must not interfere with the movement of the hydraulic lines at key loader arm pivot points. The required movement of the cylinders relative to one another hinders development of a single satisfactory guard structure capable of protecting numerous hydraulic lines and cylinders of a front end loader.

In addition to being subject to snagging during operation, exposed hydraulic lines also often create an unrefined appearance for the vehicle, as shown in FIGS. 1-4 of the present application. Improvements to the appearance of hydraulic cylinders and lines have been proposed, such as those shown in U.S. Pat. No. D184,544 issued to Pessler, U.S. Pat. No. D194,362 issued to Prince, and U.S. Pat. No. D408,420 issued to Büter. Previous attempts to reduce the appearance of hydraulic lines have involved complicated and expensive methods such as the hydraulic cylinder with dual internal fluid conduits disclosed in U.S. Pats. No. 7,243,593 and 6,994,512 issued to Westendorf. Further improvements, however, in the appearance, cost, and function of devices that protect both hydraulic lines and hydraulic cylinders are desired.

There have been attempts to develop guards for hydraulic lines and cylinders such as those disclosed by U.S. Pat. Nos. 4,265,063 and 4,267,674 issued to Muller. However, these guards disclosed by Muller do not completely surround the hydraulic cylinders and lines. Additionally, the Muller guards do not significantly immobilize portions of the hydraulic lines adjacent to the hydraulic cylinders. The Muller guards are also fabricated from heavy sheet metal, making them expensive to fabricate, install and replace, and therefore not readily adaptable for certain applications, especially on lighter duty vehicles.

Accordingly, an object of the present invention is to provide a guard structure that protects hydraulic cylinders and lines from damage.

Another object of the present invention is to provide a guard structure that is lightweight and easily replaceable.

A further object of the present invention is to provide a structure that does not interfere with the movement of a boom assembly.

Finally, an object of the present invention is to provide a guard structure that is economical to manufacture and refined in appearance.

SUMMARY OF THE INVENTION

The present invention provides an improved hydraulic cylinder and line guard. The guard protects both the hydraulic cylinder and portions of the hydraulic line while significantly removing the appearance of the hydraulic lines. While maintaining the flexibility of the hydraulic lines at pivot points, the guard inhibits the movement of the line near the cylinder thereby reducing wear on the line. The claimed invention also achieves the important objective of providing an aesthetically pleasing smooth appearance and an easily replaceable guard for hydraulic cylinders and lines.

The improved guard is achieved by utilizing a resilient guard to cover both the cylinder and the line. The guard may be formed from a single stretchable resilient tube that is deformed to enclose both the line and the cylinder, wherein a cross-section of the guard is defined primarily by combined cross sections of the cylinder adjacent to the line. The guard may also be formed from multiple interconnected resilient segments that combine to substantially enclose a hydraulic line and cylinder. The guard may further have a raised wear surface arranged in an ornamental and/or functional pattern.

These and other advantages will become apparent as this specification is read in conjunction with the accompanying drawings and claims.

BRIEF DESCRIPTION OF THE DRAWINGS

FIG. 19 is a cross-sectional view of a corrugated type hydraulic line and cylinder guard having fastening features.

FIG. 20 is a cross-sectional view of a corrugated type hydraulic line and cylinder guard having fastening features.

FIG. 23 is a cross-sectional view of a hydraulic line and cylinder guard with areas of increased thickness near the hydraulic line.

FIG. 24 is a cross-sectional view of a line and cylinder guard with areas of increased thickness near the hydraulic line.

FIG. 28 is a cross-sectional view of a hydraulic line and cylinder guard having proportions based on the golden ratio.

FIG. 29 is a cross-sectional view of a hydraulic line and cylinder guard having a raindrop shaped cross-section.

DETAILED DESCRIPTION

The present invention may be used with any type of actuator powered by an external source. The guard of the present invention is particularly suited for applications where the actuator and lines supplying the actuator may be damaged. The improved guard may be used with actuators in and on machinery. However, for descriptive purposes, the actuator guard will be described protecting hydraulic lines and hydraulic cylinders on a front end loader.

Figure 1:
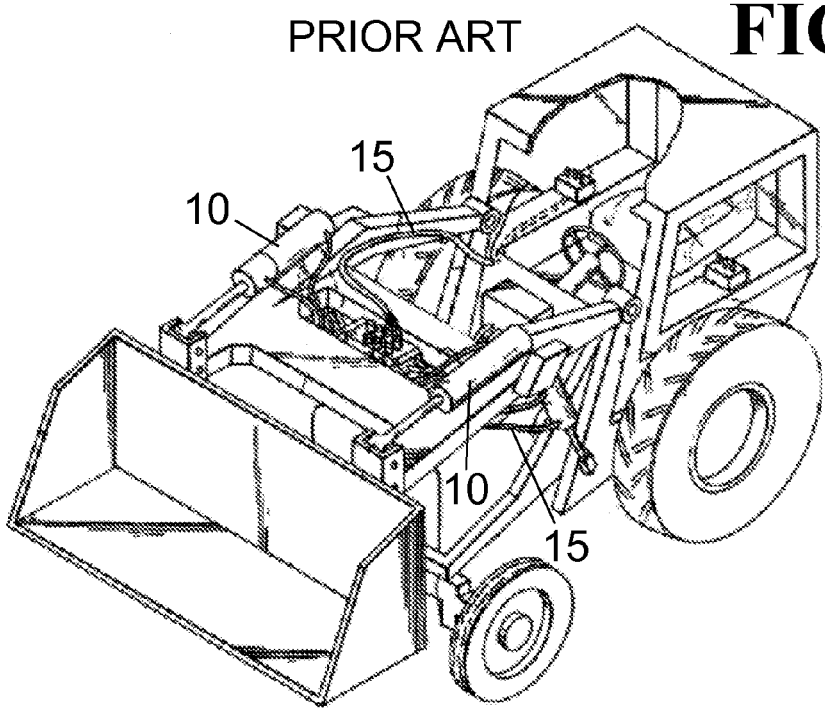
PRIOR ART FIG. 1
FIG. 1 is a side view of a loader having exposed hydraulic lines with an unrefined appearance.
Figure 2:
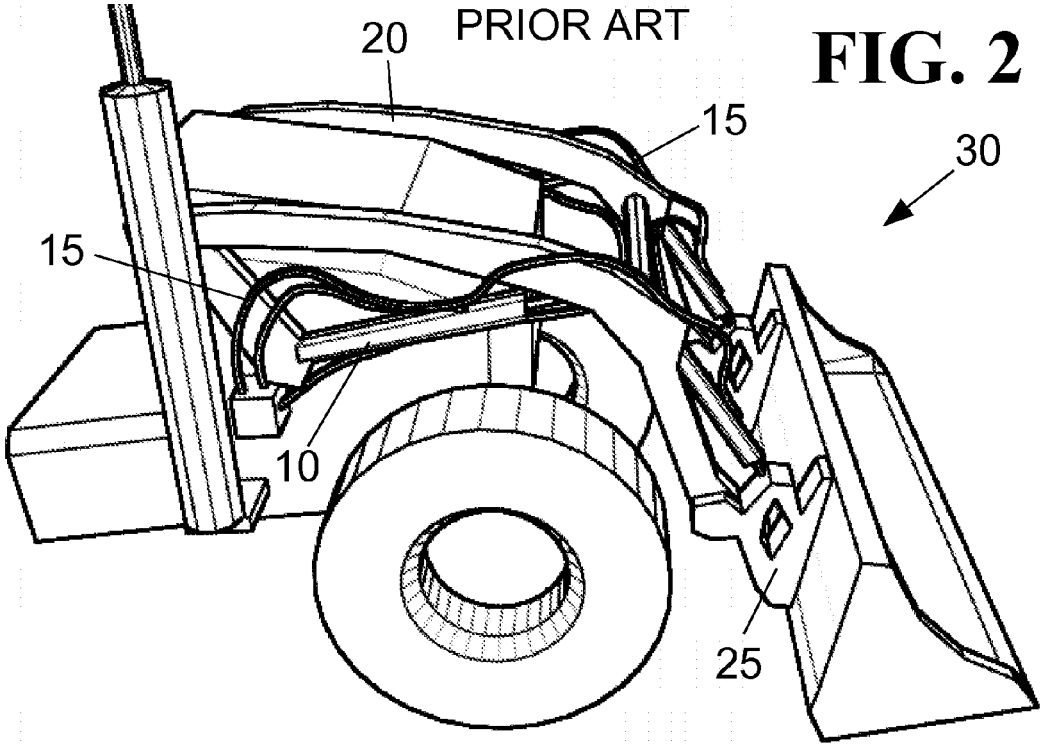
PRIOR ART FIG. 2
FIG. 2 is a side perspective view of a loader having exposed hydraulic lines with an unrefined appearance.
Figure 3:
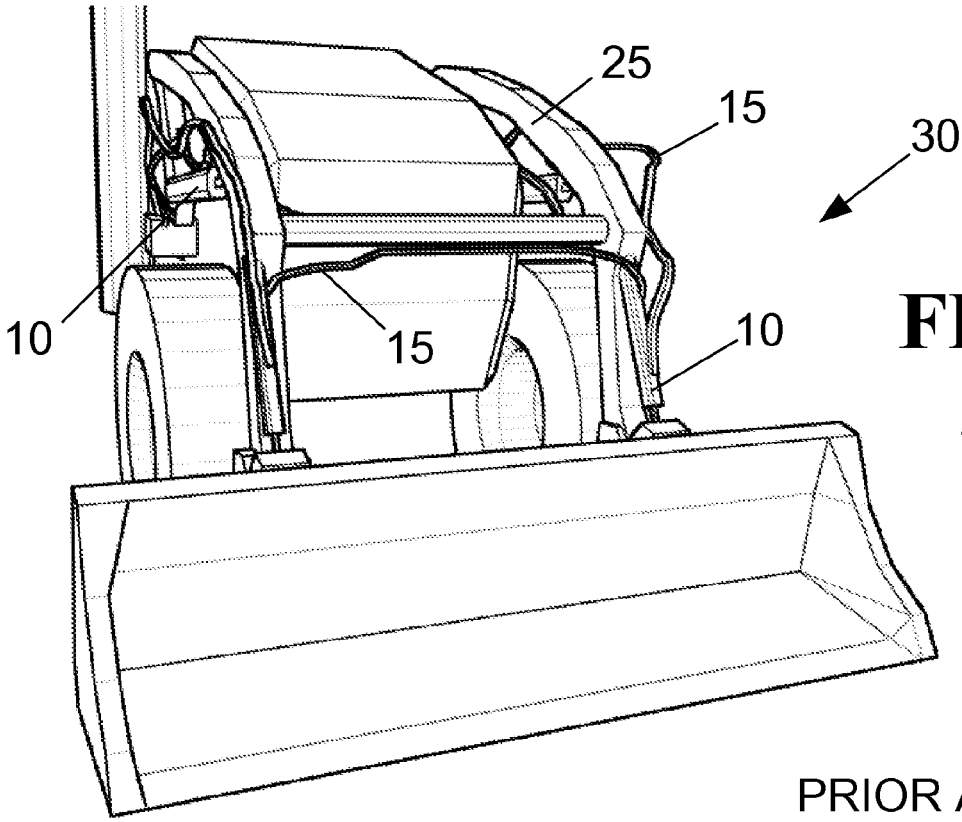
FIG. 3 PRIOR ART
FIG. 3 is a front perspective view of a loader having exposed hydraulic lines with an unrefined appearance.
Figure 4:
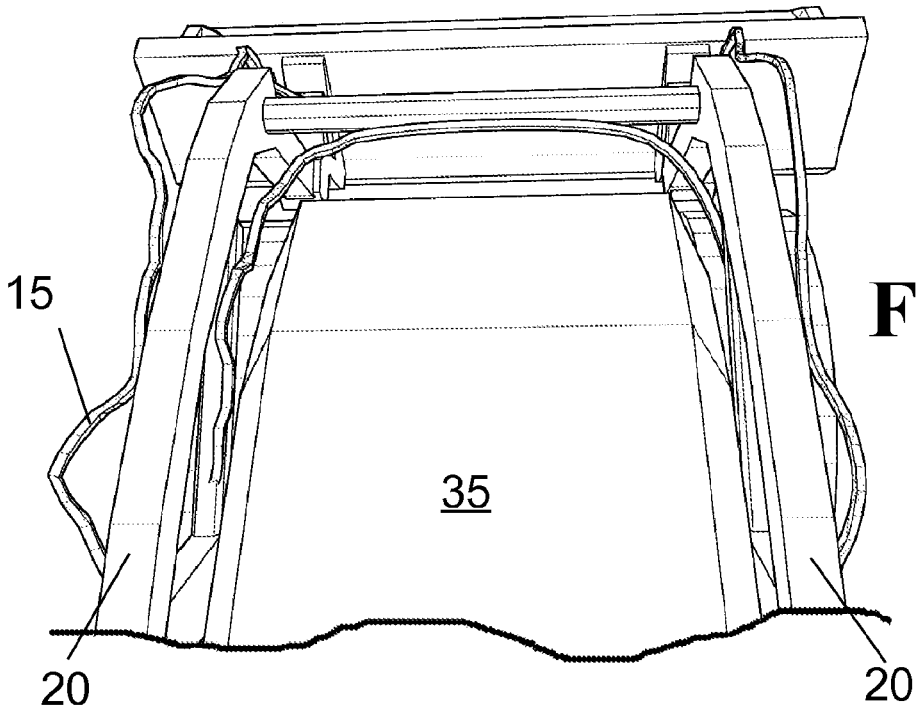
FIG. 4 is a rear perspective view of a loader having exposed hydraulic lines with an unrefined appearance.
Figure 5:
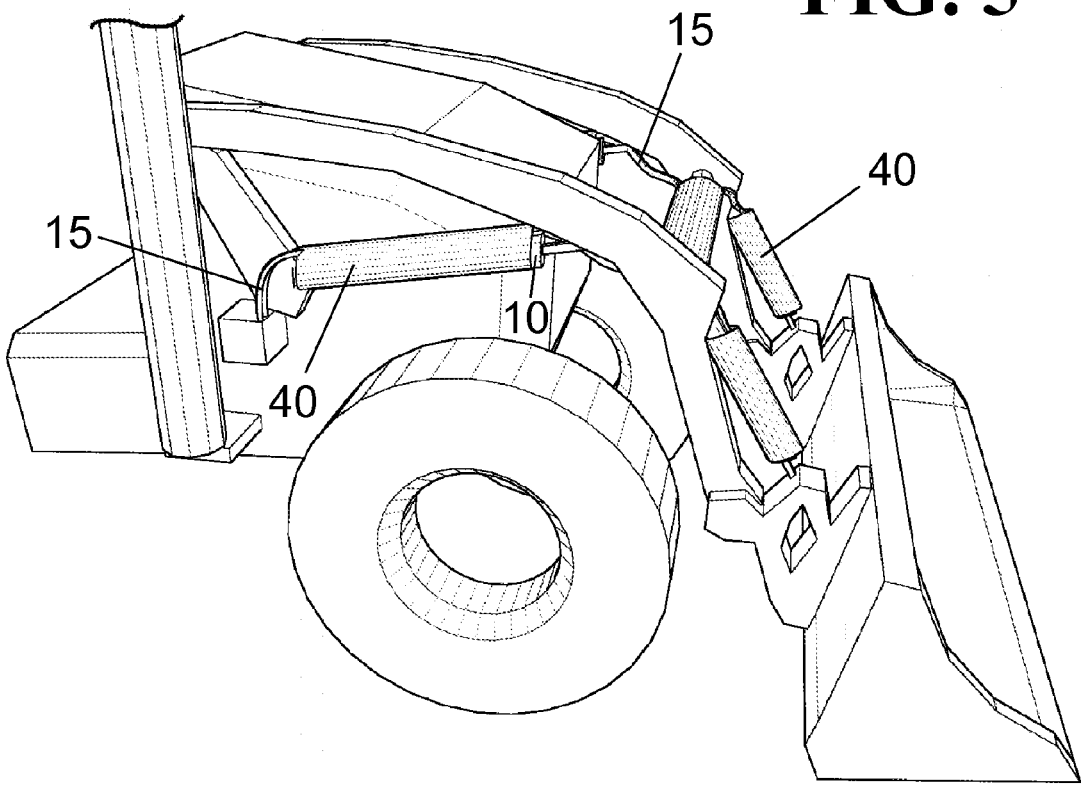
FIG. 5 is a side view of a loader having cylinders and lines surrounded by guard structures.
Figure 6:
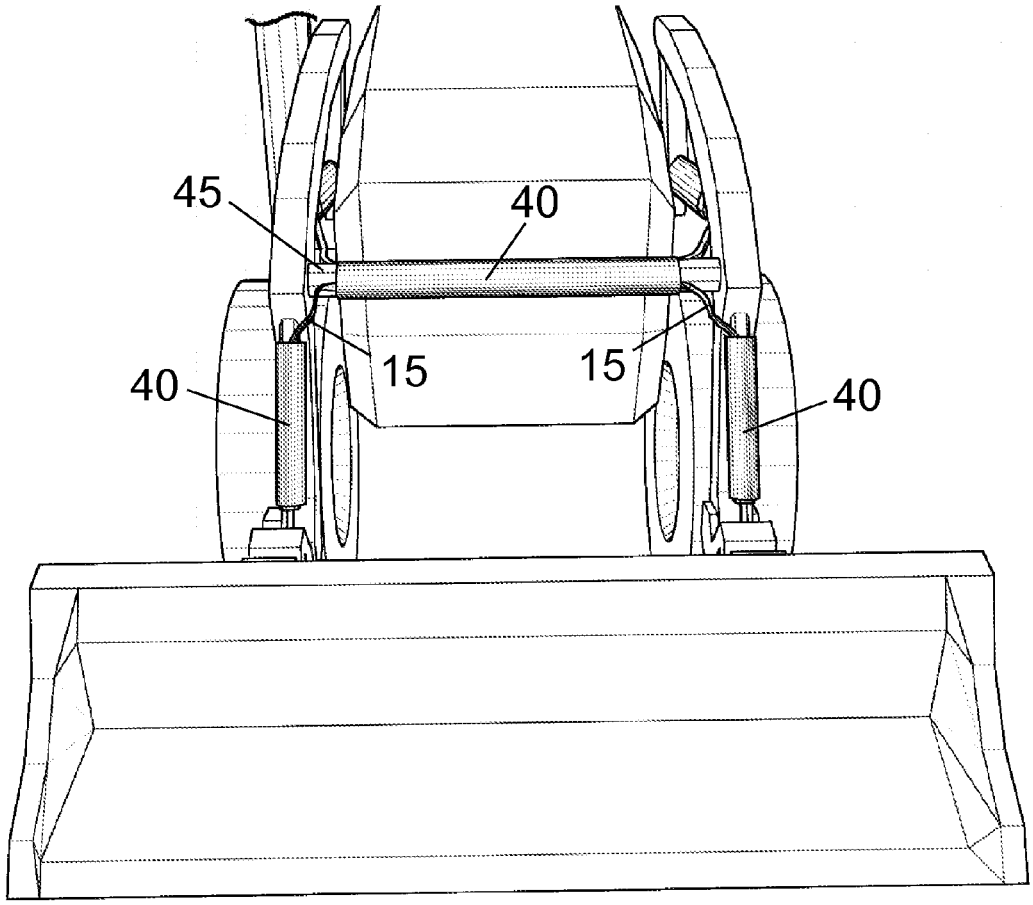
FIG. 6 is a front view of a loader having hydraulic cylinders and lines surrounded by guard structures.

As shown in FIGS. 5 and 6, the hydraulic cylinder and line guards 40 substantially surround the sides of the hydraulic cylinders 10 of the loader while also surrounding portions of the hydraulic lines 15. The guards 40 are preferably comparable in length to the cylinders that they surround so that the appearance of the lines and cylinders is minimized. The inventor also contemplates the use of multiple smaller guards or a longer guard that also covers a portion of a cylinder end.

The guards may substantially limit the movement of the surrounded portions of the hydraulic lines relative to the hydraulic cylinder. By limiting the movement of the hydraulic lines relative to the cylinders, the guard structures reduce the wear on the lines. A single guard may surround a hydraulic cylinder and more than one line. Although in the preferred embodiment of the invention, the hydraulic lines surrounded by the guards are substantially immobile relative to the guard, a guard that allows movement of the hydraulic line is within the scope of the invention. Guards that surround many lines may substantially immobilize one or more lines while allowing relatively free movement of one or more hydraulic lines.

The cylinder and line guards 40 are preferably constructed out of a resilient material such as rubbers, urethanes, and plastics. The guards are preferably constructed from an inexpensive material to facilitate replacement if the guards should become damaged or unsightly. Materials that are move flexible than the hydraulic line are preferred in order to reduce the likelihood of the guard wearing away the hydraulic line at a wear point. Additionally, constructing the guards from low cost materials facilitates replacement and specialization of the guards based on the application for which the loader is utilized. For example, highly reflective guards may be employed if the loader is used for evening street snow removal, while extra thick guards may be employed when the loader is used for clearing brush or trees.

The guards may be constructed of a material that must be stretched to fit around the hydraulic cylinder and lines. The entire guard may be constructed of a significantly stretchable material such as rubber, or portions of the guard may be rigid while other portions are stretchable. In one embodiment of the invention, the guard is made from composite materials of varying elasticities so that certain portions of the guard are able to stretch more than others.

In addition to covering hydraulic cylinders and hydraulic lines, the guards may be used to cover hydraulic lines adjacent to other features on the loader such as the cross beam 45 between loader arms. The guards located on non-cylinder portions may be colored, textured, or ornamented similar to the guards on the hydraulic cylinders to provide a loader of refined appearance.

Figure 7:
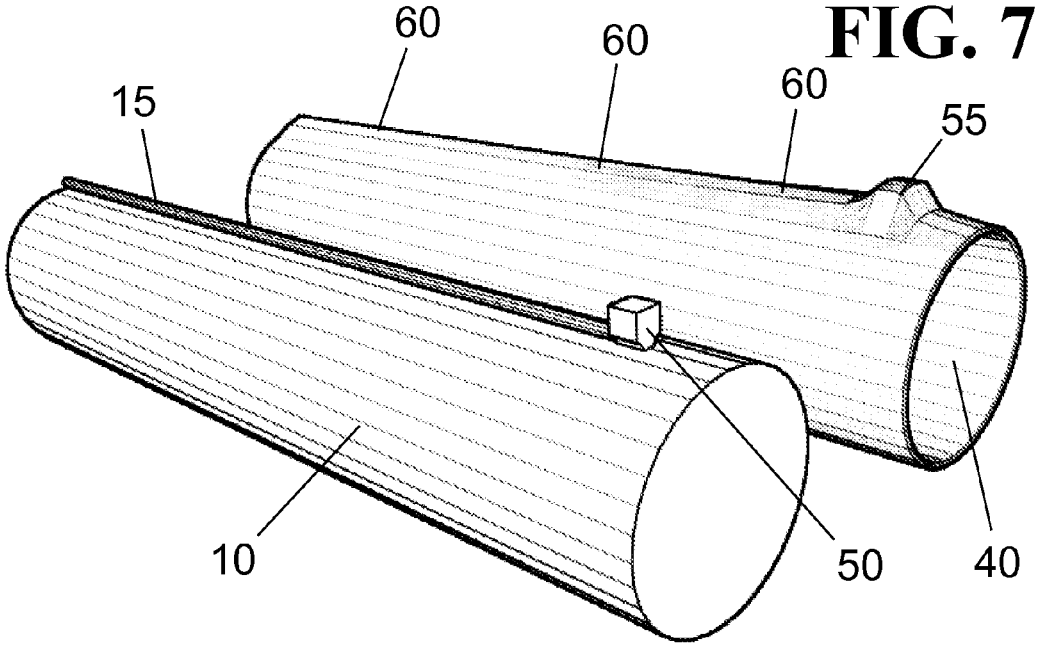
FIG. 7 is a perspective view of a hydraulic line, a hydraulic cylinder, and a guard structure of the present invention having features adapted for surrounding a hydraulic line and cylinder.
Figure 8:
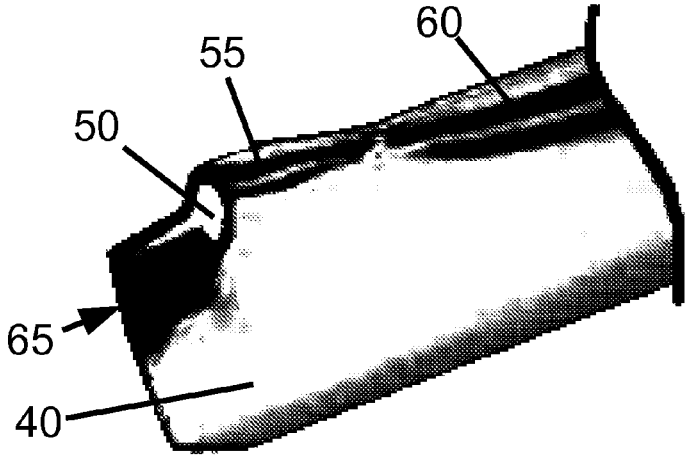
FIG. 8 is a partial perspective view of a hydraulic cylinder, fitting, and guard.
Figure 9:
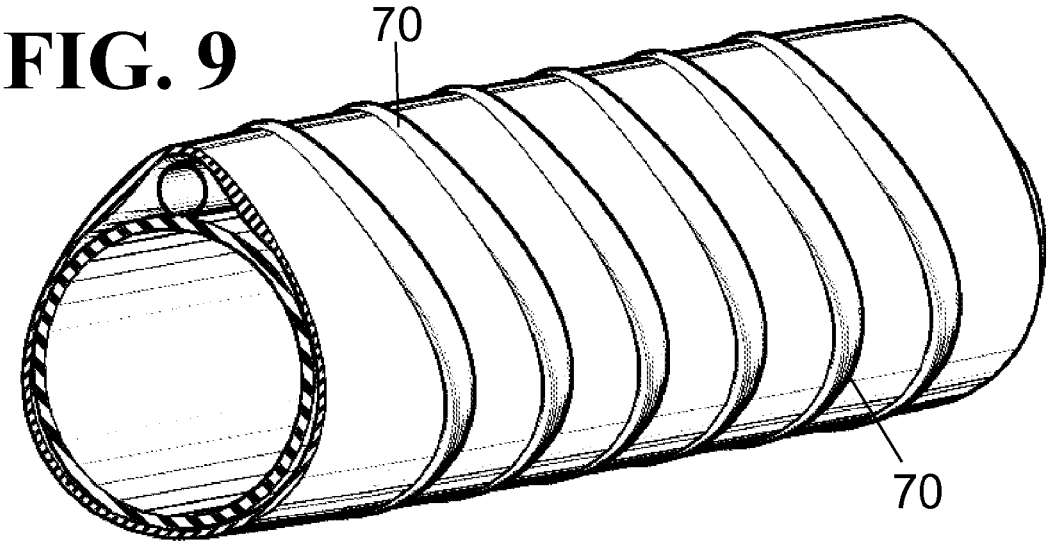
FIG. 9 is a partial perspective view of a hydraulic line and cylinder surrounded by a guard structure with a wear surface having a functional and ornamental design.
Figure 10:
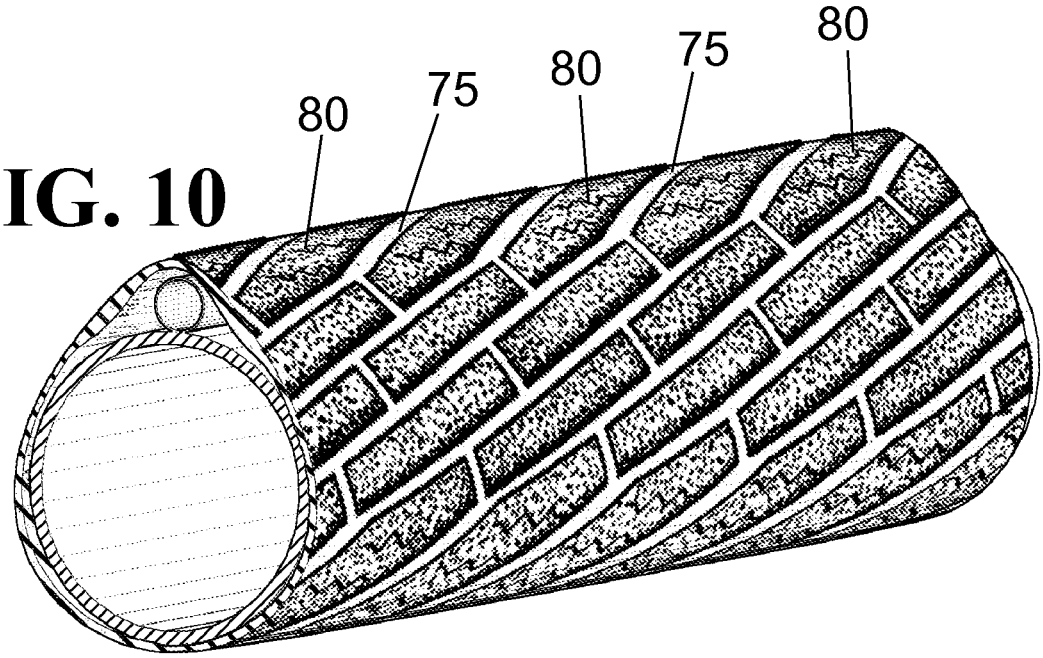
FIG. 10 is a partial perspective view of a hydraulic line and cylinder surrounded by a guard structure with a wear surface having angled grooves and protrusions.
Figure 11:
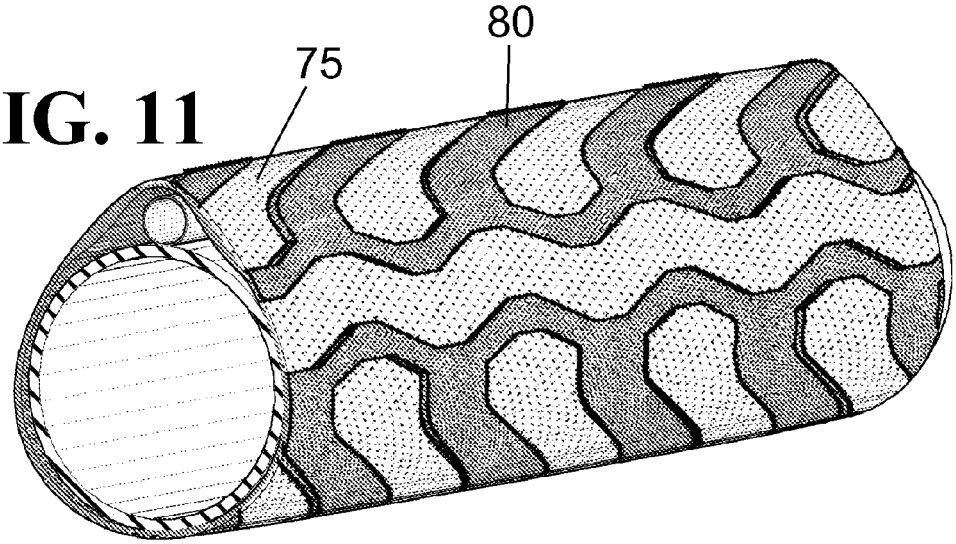
FIG. 11 is a partial perspective view of a hydraulic line and cylinder surrounded by a guard structure with a wear surface having angled grooves and protrusions.

FIGS. 7 and 8 illustrate a hydraulic cylinder 10 connected to a hydraulic line 15 by a hydraulic fitting 50. The hydraulic fitting cooperates with the hydraulic cylinder to form a substantially leak-free connection between the hydraulic line and the hydraulic cylinder. The guard 40 shown has a fitting pocket 55 adapted to cover the hydraulic fitting and a line channel 60 adapted to cover the hydraulic line. The fitting pocket and the line channel may be designed to accept a variety of fitting/line sizes, or the pocket and channel may be specifically constructed to cover a single size of fitting and line.

Although the hydraulic fitting is designed to provide a substantially leak free connection between the hydraulic line and cylinder, the quality of the connection may be degraded over time due to forces exerted upon the cylinder fitting. As shown in FIG. 8, the guard may include a fitting gap 65 to facilitate inspection of the fitting-cylinder connection.

Figure 12:
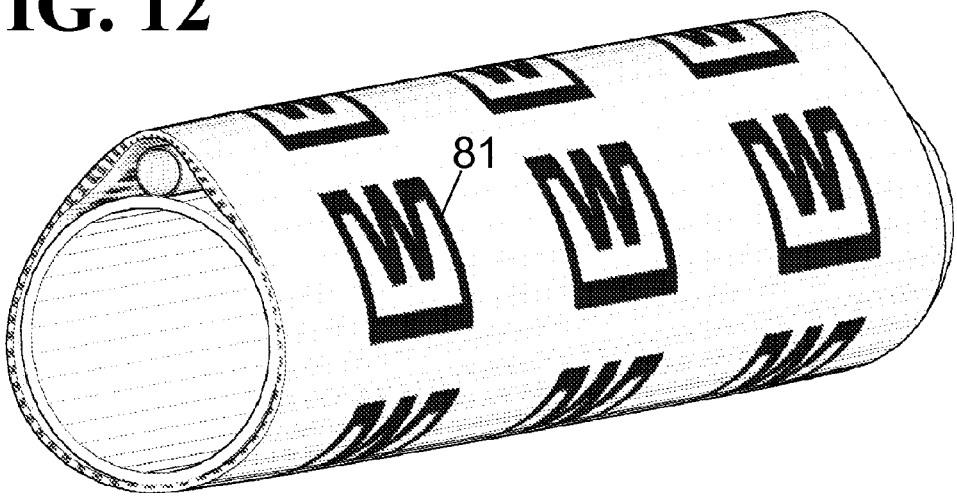
FIG. 12 is a partial perspective view of a hydraulic line and cylinder surrounded by a guard structure with a wear surface in the shape of a commercial logo.

FIGS. 9-12 illustrate guards with patterns on the exterior of the guard. The pattern 70 shown in FIG. 9 serves to provide both an ornamental design of refined appearance and a wear surface of increased thickness. The guard patterns shown in FIGS. 10 and 11, like tire tread, may have a plurality of grooves 75 and projections 80 designed to deflect material away from the hydraulic cylinder guard. As shown in FIG. 12, the projections and wear surfaces may also take the form of logos 81 or lettering on the hydraulic line and cylinder guard.

Figure 13:
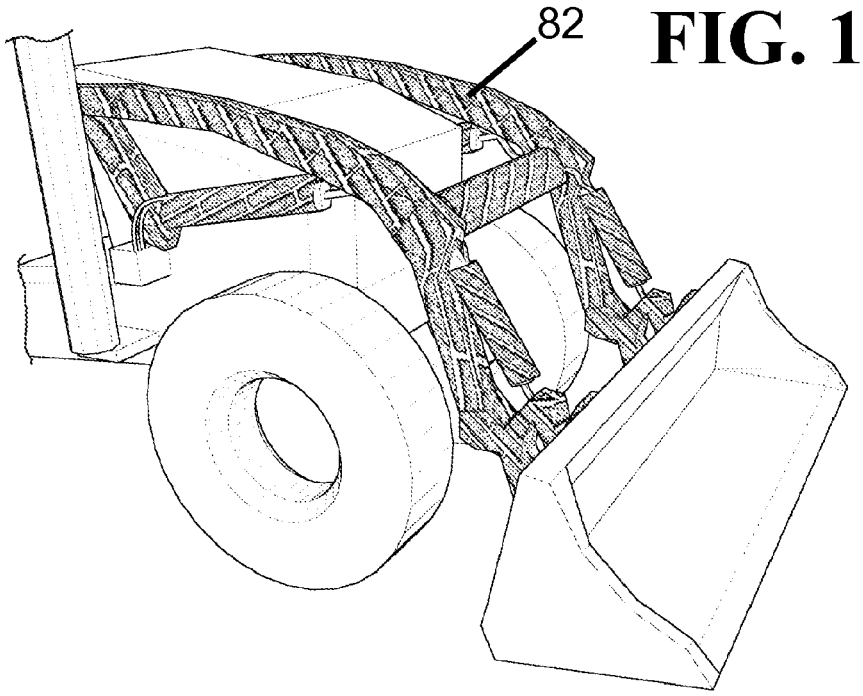
FIG. 13 is a perspective view of a loader with hydraulic lines and cylinders surrounded by guard structure with a wear surface having angled grooves and protrusions; the loader arms having a design similar in design to the guard structures.
Figure 14:
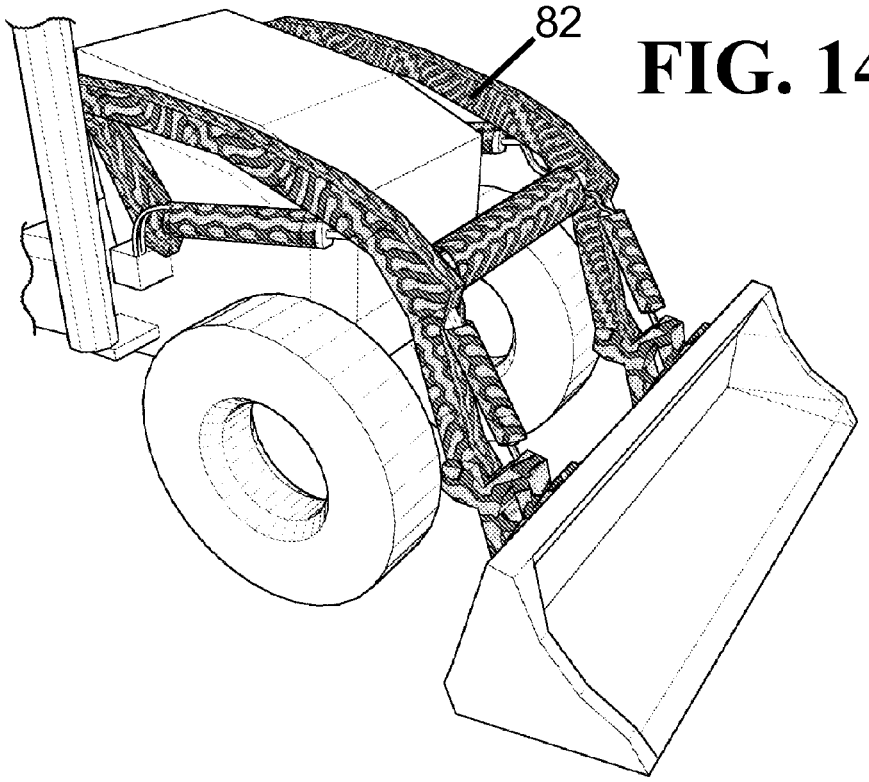
FIG. 14 is a perspective view of a loader with hydraulic lines and cylinders surrounded by guard structure with a wear surface having angled grooves and protrusions; the loader arms having a design similar in design to the guard structures.
Figure 15:
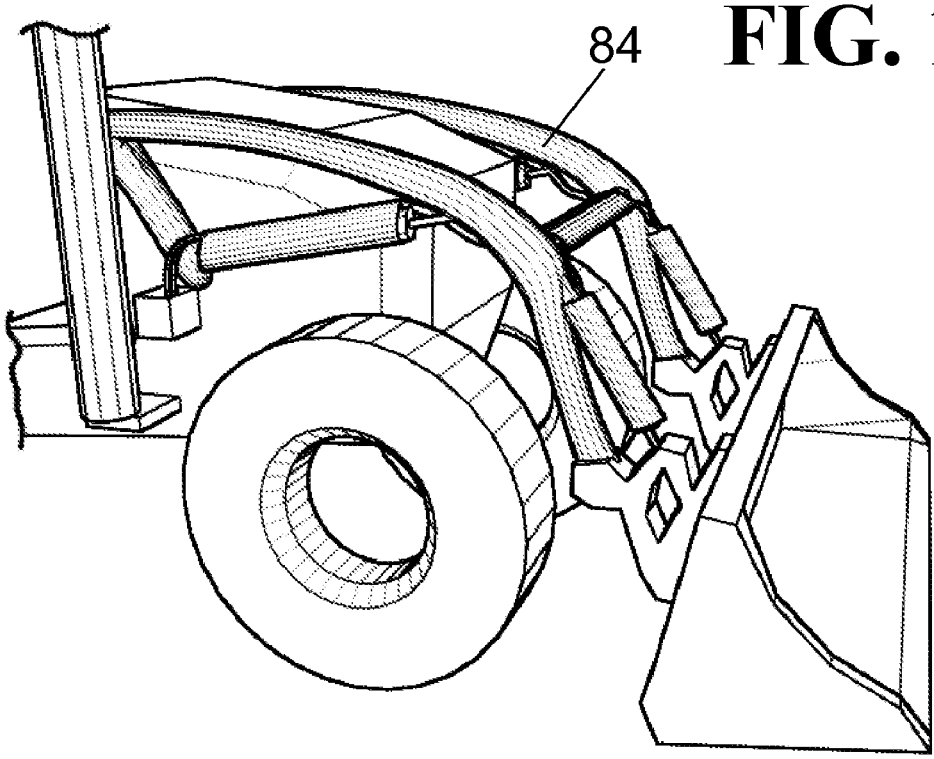
FIG. 15 is a perspective view of a loader having loader arms surrounded by guard structures.

FIGS. 13 and 14 illustrate loaders having loader arms with a decorative and functional arm pattern 82 similar in appearance to the pattern on the hydraulic line and cylinder guards. Materials used in applying the design to the loader arm may include with paint, decals, or other decorative devices. Alternatively, an arm guard 84 may be connected to the loader arms as shown in FIG. 15. The arm guard may be constructed from materials similar to those of the hydraulic line and cylinder guard or the arm guard may be constructed from lighter weight less robust materials because of the robust nature of loader arms. The loader arm guard may also primarily function to protect the loader arm from corrosion.

Figure 16:
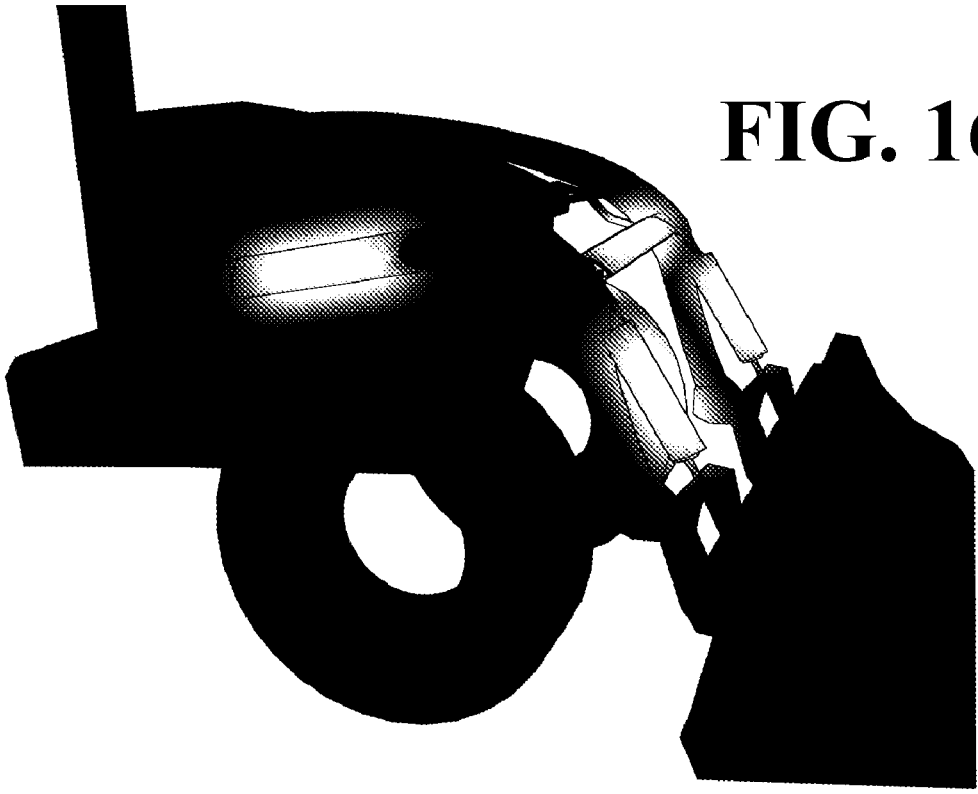
FIG. 16 is a perspective view of a darkened loader illuminated by highly reflective guard structures.
Figure 17:
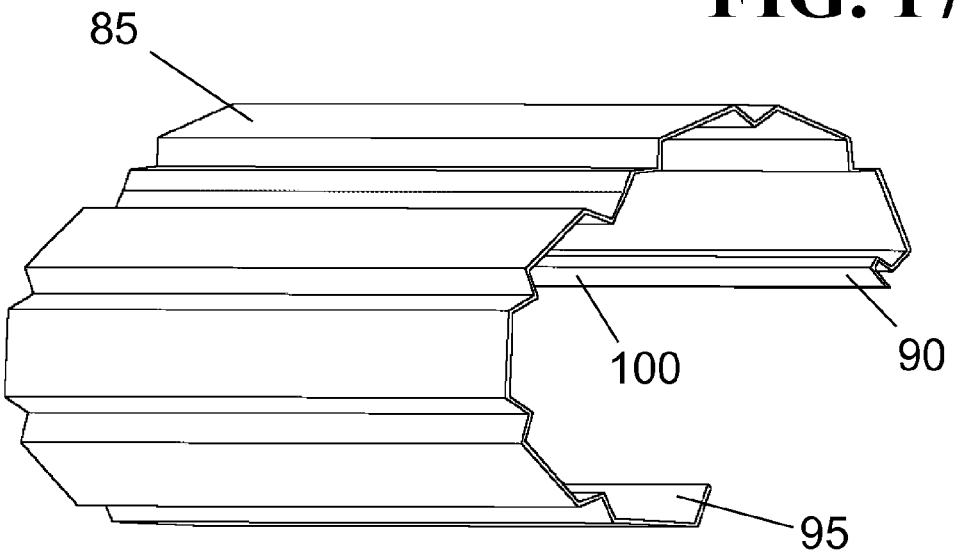
FIG. 17 is a perspective view of a corrugated type hydraulic line and cylinder guard with fastening features.
Figure 18:
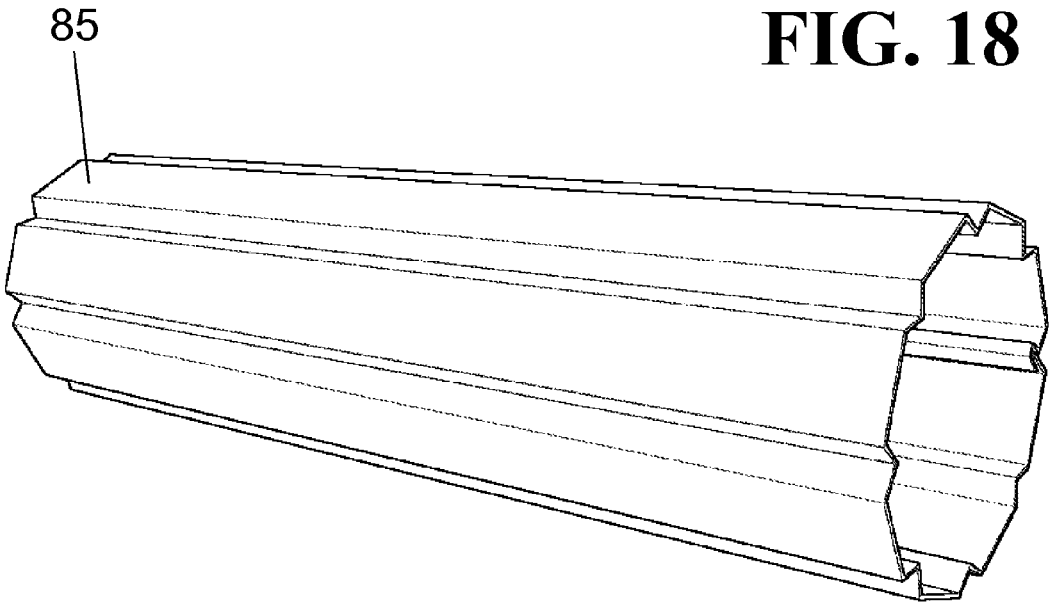
FIG. 18 is a perspective view of a corrugated type hydraulic line and cylinder guard having fastening features.

A darkened loader illuminated by highly reflective hydraulic cylinder guards is shown in FIG. 16. Reflective materials that may be used in the construction of the guard include various metals, glasses, ceramics, SilverLux™ (a product of Minnesota Mining and Manufacturing), and plastics coated with metallic layers such as silver, aluminum, and gold FIGS. 17-20 illustrate a hydraulic cylinder guard with a corrugated shape 85. In addition to providing a refined appearance for the hydraulic cylinder guard, the corrugated shape 85 allows the guard to compress when the guard is impacted, thus absorbing some of the force of the impact. Furthermore, the corrugated shape allows the guard to expand and surround hydraulic cylinders of various sizes.

The hydraulic line and cylinder guard shown in FIGS. 17-20 has a first connector 90 and a second connector 95 that allows the guard to be opened along a seam 100. The connectors utilized may include, but are not limited to hooks, screws, bolts, clamps, and fabric hook and loop fasteners. Guards that have lengthwise seams may be more easily installed over hydraulic cylinders and lines than seamless guards because removing the hydraulic cylinders from a loader is often a difficult process.

Figure 21:
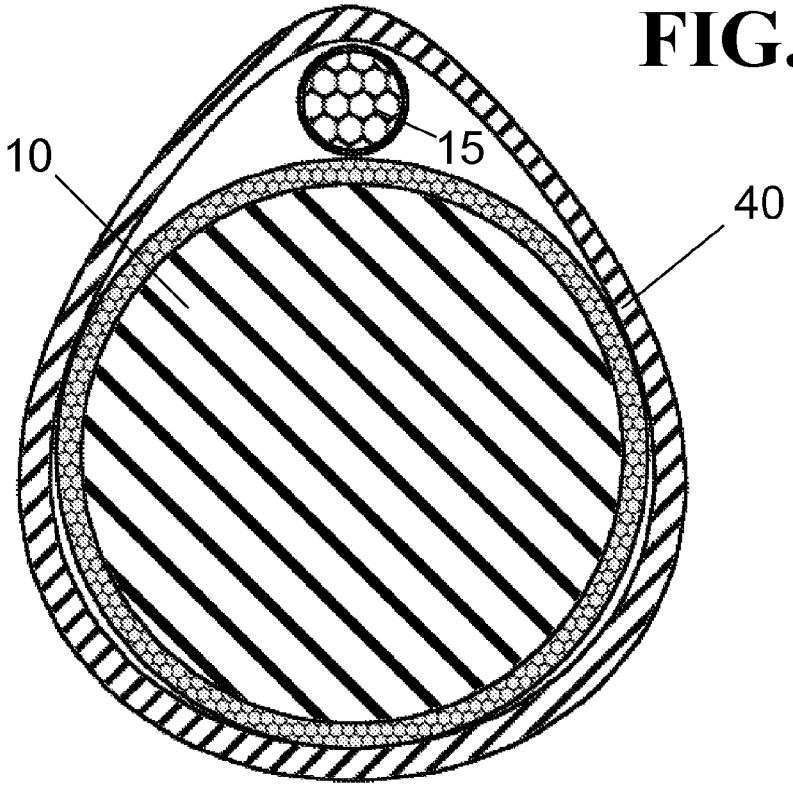
FIG. 21 is a cross-sectional view of a hydraulic line and cylinder guard surrounding a cylinder and a conduit.

FIG. 21 illustrates the cross-section of an actuator assembly with a hydraulic cylinder guard 40 surrounding a hydraulic cylinder 10 and a hydraulic line 15. The guard has a substantially uniform thickness that simplifies the manufacture of the guard. The substantially uniform thickness of the guard also simplifies installation because the guard may be placed around the hydraulic line and cylinder in any rotational orientation.

Figure 22:
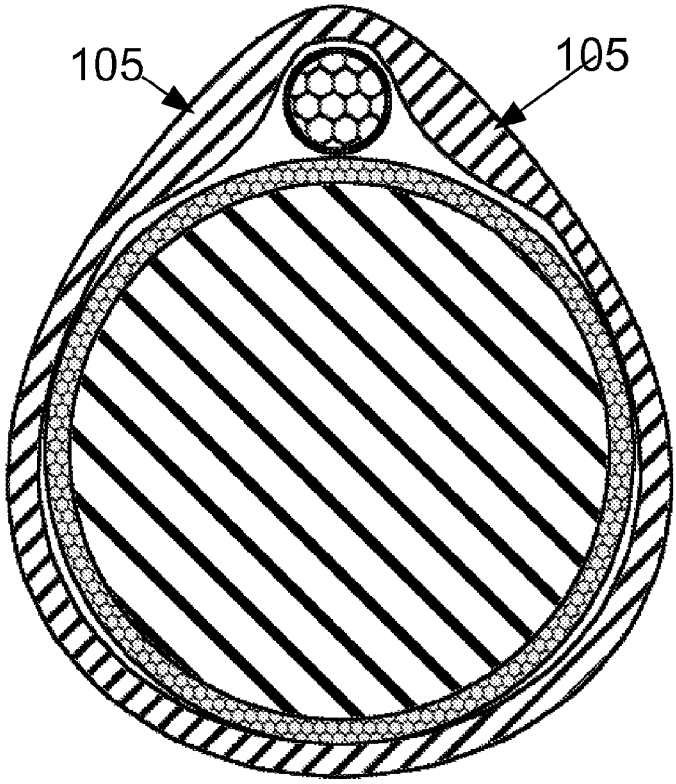
FIG. 22 is a cross-sectional view of a hydraulic line and cylinder guard with areas of increased thickness near the hydraulic line.

FIG. 22 illustrates a cross-section of a hydraulic cylinder guard having regions of increased thickness 105. The areas of increased thickness provide additional protection for the hydraulic line, and also help to limit the movement of the hydraulic line relative to the hydraulic cylinder.

Figure 25:
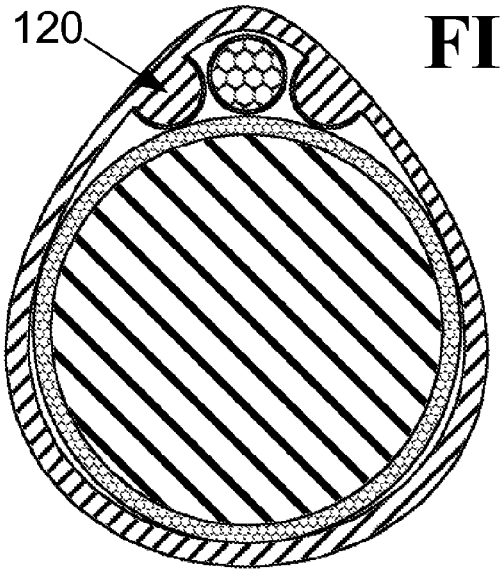
FIG. 25 is a cross-sectional view of a hydraulic line and cylinder guard having rounded protrusions near the hydraulic line.

FIG. 23 illustrates a cross-section of a hydraulic cylinder guard with an inner circumference 110 substantially defined by the hydraulic cylinder. The guard also has a channel 115 in which the hydraulic line is positioned. The increased surface area of the guard in contact with the hydraulic cylinder assists in preventing rotation of the guard (and hydraulic line) around the hydraulic cylinder. Additionally, the narrow channel significantly limits the movement of the hydraulic line portions within the guard. FIG. 24 shows another cross section of a hydraulic cylinder having an inner circumference substantially defined by the hydraulic cylinder. FIG. 25 illustrates a cross-section of a guard with two rounded protrusions 120 that are similar in size to the hydraulic line 15. The rounded protrusions cooperate to form a groove in the guard that limits the movement of the hydraulic line.

Figure 26:
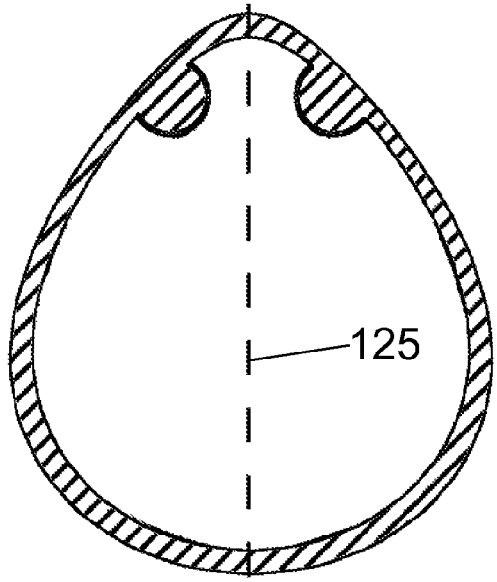
FIG. 26 is a cross-sectional view of a hydraulic line and cylinder guard having an axis of symmetry.
Figure 27:
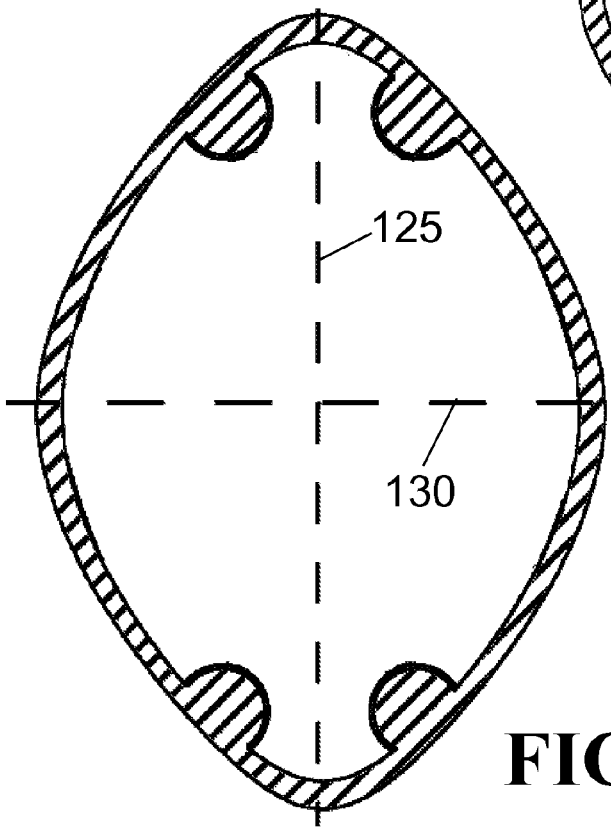
FIG. 27 is a cross-sectional view of a hydraulic line and cylinder guard having two axes of symmetry.

FIGS. 26 and 27 illustrate line and cylinder guards where a first axis of symmetry 125 and a second axis of symmetry 130 contribute to the refined appearance of the guard. Symmetry is often associated with an aesthetically pleasing appearance. In addition to having ornamental value, the axes of symmetry facilitate manufacture of the guard. For example, less tooling may be required to produce a highly symmetrical line and cylinder guard than an unsymmetrical guard. Installation of the guard is also facilitated because highly symmetrical guards may be installed in a variety of orientations.

FIG. 28 illustrates a guard with cross-sectional proportions based on the golden ratio. The guard has a longest radius 135 (as measured from the center of the hydraulic cylinder) and a shortest diameter 140 that are in a ratio of approximately 1:1.618, commonly referred to as the golden ratio. The golden ratio has been attributed to an aesthetically pleasing appearance and is found in Renaissance art and architecture, such as works by Leonardo Da Vinci. Additionally, the golden ratio has been attributed to the geometry of the Pyramids of Giza and the Parthenon. In another embodiment of the invention, the longest radius and a perpendicular radius form two sides of a golden triangle.

FIG. 29 illustrates a hydraulic line and cylinder guard having a raindrop shaped cross-section 145. In addition to providing an aesthetically pleasing shape based on nature, the pointed section 150 of the raindrop shaped guard helps to deflect falling objects away from the hydraulic cylinder and line. The increased thickness of the guard at the pointed section relative to the average thickness further serves to absorb and disperse the force of an object impacting on or near the hydraulic line.

The hydraulic line protectors may also surround portions of the loader arms. Access vents to facilitate inspection of the hydraulic lines may be incorporated into the protectors. The shape and the arrangement of the access vents may be ornamental and/or functional. Features and slots in the protectors may be adapted to be near hydraulic cylinders. The features and slots may include cut-away areas that prevent the cylinders from wearing upon the hydraulic line protectors or reinforced overhangs may be used to shield portions of the cylinders from dirt and rain.

A removable access panel may be incorporated into the hydraulic line protectors to facilitate inspection and repair of hydraulic lines. The removable access panel may also protect the hydraulic lines from foreign objects as well as dirt and debris that could corrode portions of the hydraulic lines. Similar to other features of the hydraulic line protector, the access panel may also be in an ornamental yet functional shape.

A protector may be connected to the exterior sections of a loader arm at pivot points. Because installation of the some protectors does not require the loader arms be disassembled, a variety of loaders may be retrofitted with these devices. In order to increase the number of loaders that a single design of lateral protector may be attached to, the protector may have expansion features. In addition to allowing the lateral protector to be connected to a greater variety of loader arms, the expansion features may help to prevent stretching of the lateral protector when the loader arms are operated.

The inventor contemplates several alterations and improvements to the disclosed invention. Other materials and methods of manufacture will be obvious to those of reasonable skill in the art and are within the scope of the invention. Other alterations, variations, and combinations are possible that fall within the scope of the present invention. Although various embodiments of the present invention have been described, those skilled in the art will recognize more modifications that may be made that would nonetheless fall within the scope of the present invention. Therefore, the present invention should not be limited to the apparatus described. Instead, the scope of the present invention should be consistent with the invention claimed below.

I claim:

1. An actuator assembly comprising a hydraulic cylinder with a length;

a hydraulic line for delivering a hydraulic fluid to the hydraulic cylinder, the hydraulic line having a line section adjacent to a first cylinder section of the hydraulic cylinder; and a protective sheath, the protective sheath surrounding and having a first cross-section substantially defined by the first cylinder section and the line section, the protective sheath having a corrugated shape, the corrugated shape having corrugation extending parallel to the length of the hydraulic cylinder, with a plurality of parallel ridges and furrows, wherein the plurality of parallel ridges and furrows extend parallel to the length of the hydraulic cylinder.

2. The actuator assembly of claim 1 further comprising the protective sheath having a first fastener and a second fastener, the first fastener interconnecting with the second fastener.

3. The actuator assembly of claim 2 further comprising the first cross-section including a portion of the first fastener and a portion of the second fastener.

4. The actuator assembly of claim 1 further comprising the protective sheath having a wear surface pattern on the exterior of the protective sheath.

5. The actuator assembly of claim 4 further comprising the wear surface pattern comprising a plurality of grooves and a plurality of protrusions.

6. The actuator assembly of claim 4 further comprising the wear surface pattern having an ornamental design.

7. The actuator assembly of claim 1 wherein the length of the protective sheath is less than the length of the hydraulic cylinder.

8. The actuator assembly of claim 1 further comprising the protective sheath having a first connector extending parallel to the length of the hydraulic cylinder, and a second connector interconnected with the first connector.

9. The actuator assembly of claim 8 wherein the first connector includes a fabric hook fastener and the second connector includes a fabric loop fastener.

10. The actuator assembly of claim 8 wherein the first connector includes bolts.

11. The actuator assembly of claim 1 further comprising the protective sheath having a seam extending parallel to the length of the hydraulic cylinder.

* * * * *